US006135741A

United States Patent [19]

Oehman, Jr.

[11] Patent Number: 6,135,741

[45] Date of Patent: Oct. 24, 2000

[54] RECIRCULATING FLOW PATH FOR GEAR PUMP

[75] Inventor: Robert E. Oehman, Jr., Apex, N.C.

[73] Assignee: Parker-Hannifin Corporation, Cleveland, Ohio

[21] Appl. No.: 09/354,259

[22] Filed: Jul. 15, 1999

Related U.S. Application Data

[60] Provisional application No. 60/113,436, Dec. 23, 1998.

[51] Int. Cl.[7] ..... F04C 2/18

[52] U.S. Cl. ..... 418/102; 418/206.8

[58] Field of Search ..... 418/102, 206.8

[56] References Cited

U.S. PATENT DOCUMENTS

| | | | |
|---|---|---|---|
| 1,271,970 | 7/1918 | Wood | 418/102 |
| 2,432,576 | 12/1947 | Koffer | 418/102 |
| 2,756,684 | 7/1956 | Renzo | 418/102 |
| 2,818,023 | 12/1957 | Lundstrom | 418/200 |
| 2,975,718 | 3/1961 | Hodgson | 418/102 |
| 3,251,309 | 5/1966 | Schmiel et al. | 418/78 |
| 3,499,390 | 3/1970 | Prijatel | 418/132 |
| 3,690,793 | 9/1972 | Pollman et al. | 418/102 |
| 3,802,813 | 4/1974 | Butler | 418/165 |
| 4,277,230 | 7/1981 | Müller | 418/131 |
| 5,496,163 | 3/1996 | Griese et al. | 418/200 |
| 5,522,714 | 6/1996 | Orimo et al. | 418/206.2 |
| 5,586,875 | 12/1996 | Ondrejko et al. | 418/3 |

*Primary Examiner*—John J. Vrablik
*Attorney, Agent, or Firm*—Christopher H. Hunter

[57] ABSTRACT

A gear pump includes a pump body having a pair of cylindrical gear chambers, and high pressure and low-pressure fluid ports into the chambers. A pair of cover plates enclose the open ends of the pump body. A drive gear on a drive shaft and a driven gear on an arbor shaft are rotatably supported on a pair of bearing assemblies within the gear chambers, with the drive shaft extending through an opening in at least one of the cover plates for rotation of the gears. A recirculating flow path is provided to draw fluid from the high pressure fluid port along the sides of the gears, between the bearings and the sides of the gears, axially through the bearings from the inner side of the bearings to the outer side of the bearings, and through channels formed in the respective adjacent cover plates to direct the fluid to a pair of return bores in the pump body. The return bores are parallel to one another and to the rotational axis of the gears, and tangentially intersect the low-pressure fluid port in elongated, arcuately-extending elliptical openings to direct the fluid into the central region of the intermeshing gear teeth.

20 Claims, 5 Drawing Sheets

RECIRCULATING FLOW PATH FOR GEAR PUMP

RELATED CASES

The present application claims priority to U.S. Provisional Application Ser. No. 60/113,436; filed Dec. 23, 1998.

FIELD OF THE INVENTION

The present invention relates generally to gear pumps for fluid systems.

BACKGROUND OF THE INVENTION

Gear pumps are known for handling a variety of fluids in fluid systems. Gear pumps typically include a pair of externally toothed gears which are rotatably disposed within a pair of gear chambers. A drive shaft connected to one of the gears extends through an opening in the pump housing for rotation of the gears. The pump receives fluid at low pressure in a low-pressure port, and the gear teeth rotatingly intermesh to supply the fluid at a higher pressure through a high-pressure fluid port. The ports are typically oriented perpendicular to the rotational axis of the gears, although they can also be oriented parallel to the rotational axis of the gears.

Bearings and/or wear plates are provided on the opposite side surfaces of the gears, to facilitate rotation of the gears. The bearings and wear plates can be formed as separate components, or as unitary components. The bearings can also be incorporated into the cover plates. In any case, the drive gear rotates on the drive shaft supported radially by the drive gear bearings, and the driven gear rotates on a driven shaft supported radially by the driven gear bearings. The cover plates, bearings, and/or wear plates support the drive gear and driven gear axially in the pump body.

The pumped fluid is also used for lubrication of the bearings. To this end, a flow path is typically provided from the high-pressure fluid port to the bearings. Alternatively (or in addition), leakage is allowed between the opposing surfaces of the gears and bearings. In any event, the fluid lubricates the bearings and is then returned to the low-pressure fluid port such that the lubricating fluid is intermixed with the incoming fluid.

It is believed that one disadvantage of prior pumps is that the lubricating fluid is drawn off from the sides of the gears on the high pressure side of the pump, and then returned toward the sides of the gears on the lower pressure side of the pump. This tends to allow the returning fluid to flow down the side of the low pressure port, enter the gear teeth towards the sides of the gears, and then be drawn again through the recirculating flow path. In other words, the same fluid is used again and again for lubrication purposes. This can be undesirable, as the fluid removes heat from the bearings during lubrication, and if the fluid is caused to pass again and again through the bearings, the bearings can overheat, causing damage to the pump, and degrading the fluid. The recirculated fluid also degrades (shears) as it passes between the rotating gear and bearing surfaces, which can further degrade the fluid if it is passed again and again across these surfaces, as well as affect the over-all quality of fluid passing through the pump.

As such, it is believed that there is a demand in the industry for a new and improved gear pump which has a recirculating flow path for lubrication of the bearings, and which overcomes the disadvantages noted above such that the recirculated fluid is uniformly mixed into the incoming fluid.

SUMMARY OF THE PRESENT INVENTION

The present invention provides a novel and unique gear pump with a recirculating flow path which lubricates the bearings of the gear pump, and which re-introduces lubricating fluid in such a manner that the fluid uniformly mixes into the incoming fluid stream.

According to the preferred embodiment of the present invention, the recirculating flow path includes a return inlet opening into the high pressure fluid port of the pump, a flow channel formed on an inner side of each bearing assembly facing the outlet sides of the gears for directing the fluid into the bearings, and a pair of flow channels formed on an inner surface of each cover plate, for directing the fluid out of each bearing into a respective end of a pair of return bores. The return bores comprise cylindrical bores formed parallel to one another and to the rotational axis of the gears, and extend through the pump body to a pair of return outlet openings into the low-pressure fluid port. The return bores are located on diametrically opposite sides of the low-pressure port and tangentially intersect the port upstream from the gear teeth. Each return outlet opening comprises an elongated, arcuately-extending, elliptical opening located so that the recirculated fluid is introduced centrally into the gear teeth for uniform mixing of the recirculating fluid with the incoming fluid stream.

In effect, the lubricating fluid is directed from the sides of the gears on the high-pressure side of the pump into the central area of the gears on the low-pressure side of the pump. Such a flow path minimizes recirculating the same fluid through the pump and uniformly mixes the lubricating fluid into the incoming fluid. The flow through the recirculating path could also be reversed, that is, with the fluid drawn from the central region of the gears on the high pressure side of the pump and reintroduced along the sides of the gears into the incoming fluid on the low pressure side of the pump. In either case, such a gear pump provides for proper lubrication of the bearings, and draws heat from the bearings to prevent the pump from overheating. The flow path is relatively straightforward to form in the gear pump such as by simple casting, cutting and/or drilling steps in the bearings and/or cover plates. The gear pump of the present invention is therefore also easy and cost-effective to manufacture.

Further features and advantages of the present invention will become apparent to those skilled in the art upon reviewing the following specification and attached drawings.

DETAILED DESCRIPTION OF THE PREFERRED EMBODIMENT

Figure 1:
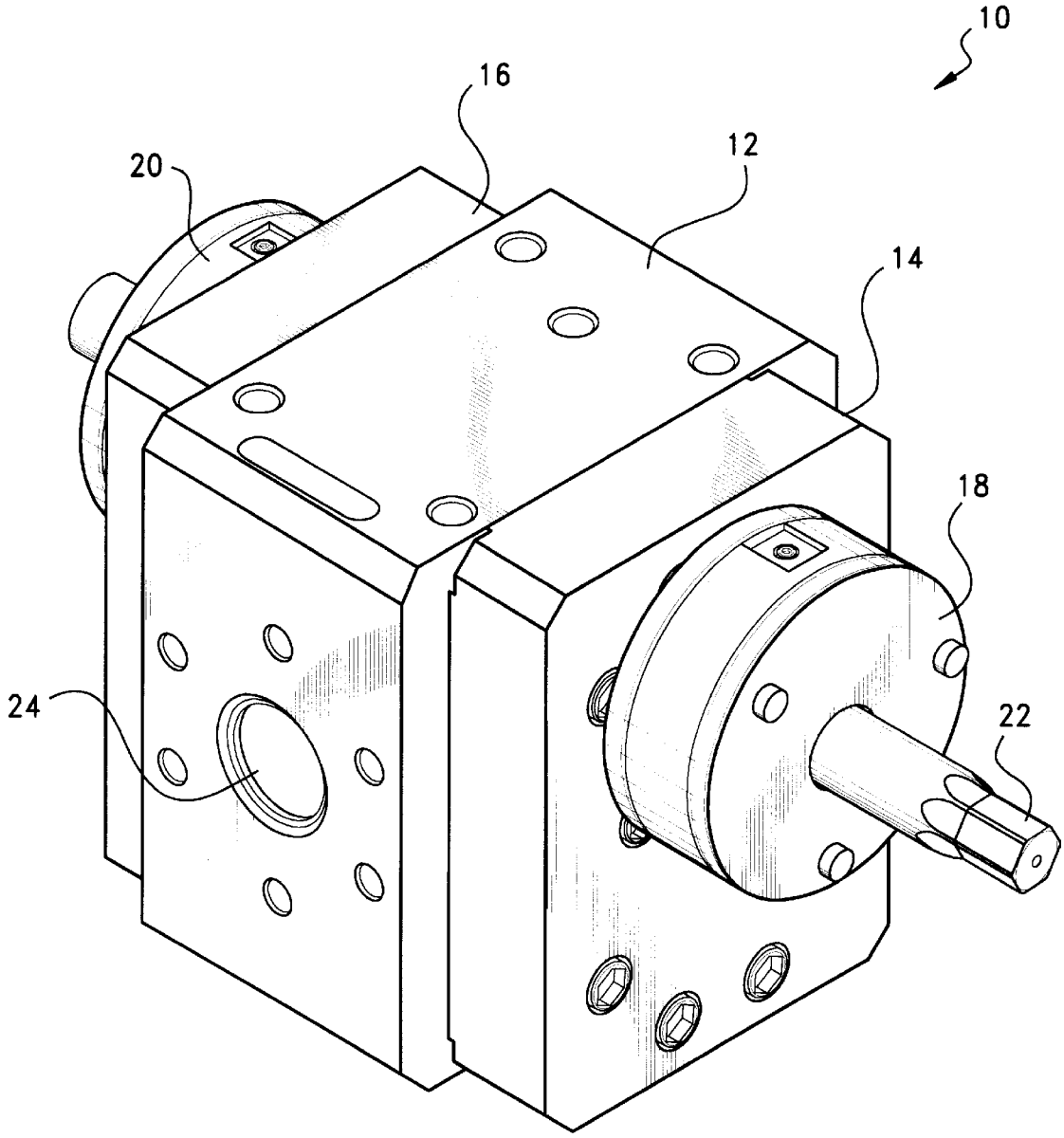
FIG. 1 is an elevated perspective view of a gear pump constructed according to the principles of the present invention.

Referring to the drawings, and initially to FIG. 1, a gear pump constructed according to the principles of the present invention is indicated generally at 10. Gear pump 10 includes a pump body 12; a cover plate 14 and 16 at either end of the pump body 12; a drive shaft sealing assembly 18, 20 associated with each of the cover plates 14, 16 respectively; and a drive shaft 22 extending through the sealing assemblies 18, 20, through cover plates 14 and 16, and through pump body 12. As will be described herein in more detail, the gear pump 10 includes a low pressure receiving port 24 for receiving low pressure fluid from a fluid system, and an opposite high pressure discharge port 26 (FIG. 3) for providing high pressure fluid to the fluid system.

Figure 2:
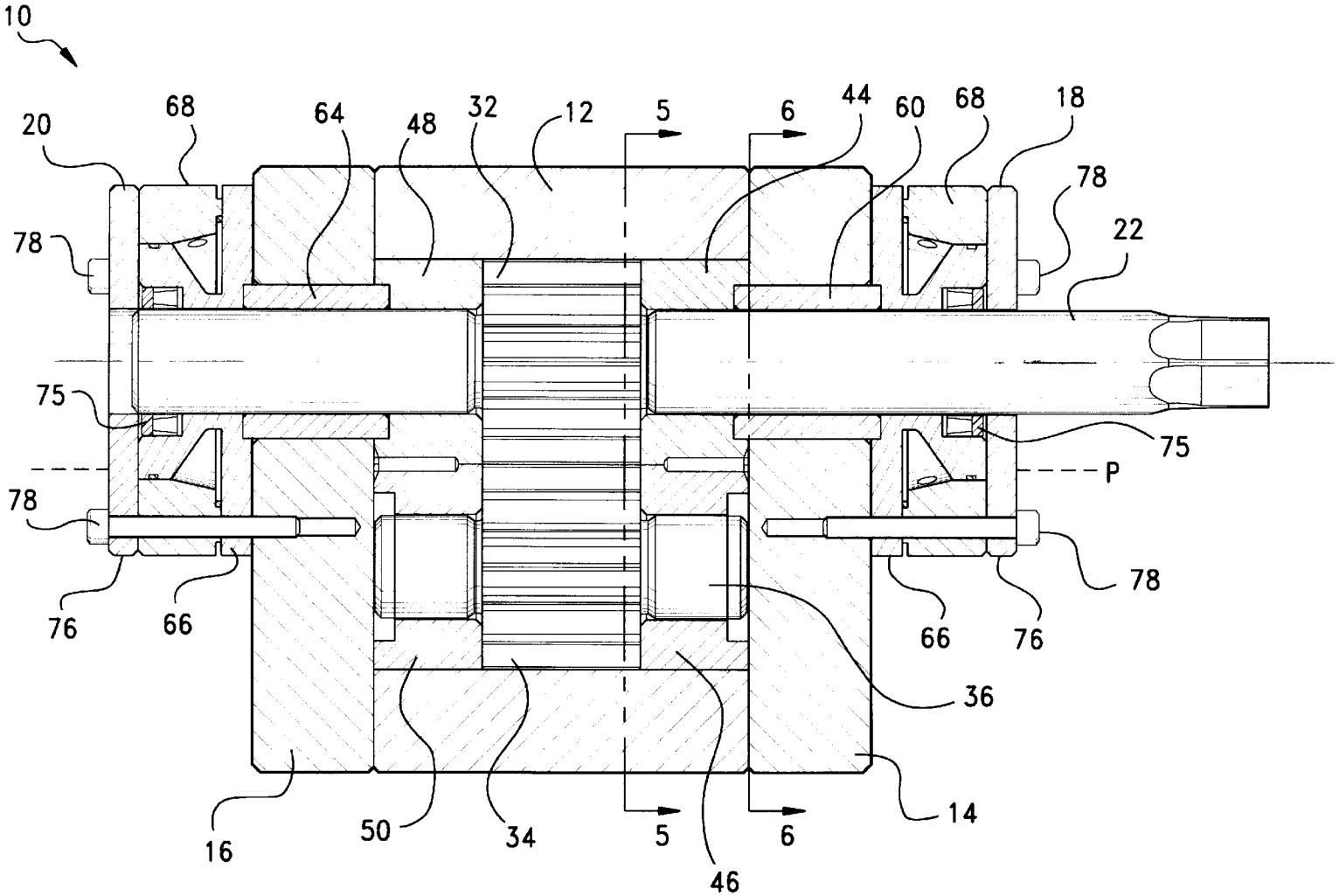
FIG. 2 is a cross-sectional side view of the gear pump of FIG. 1.
Figure 3:
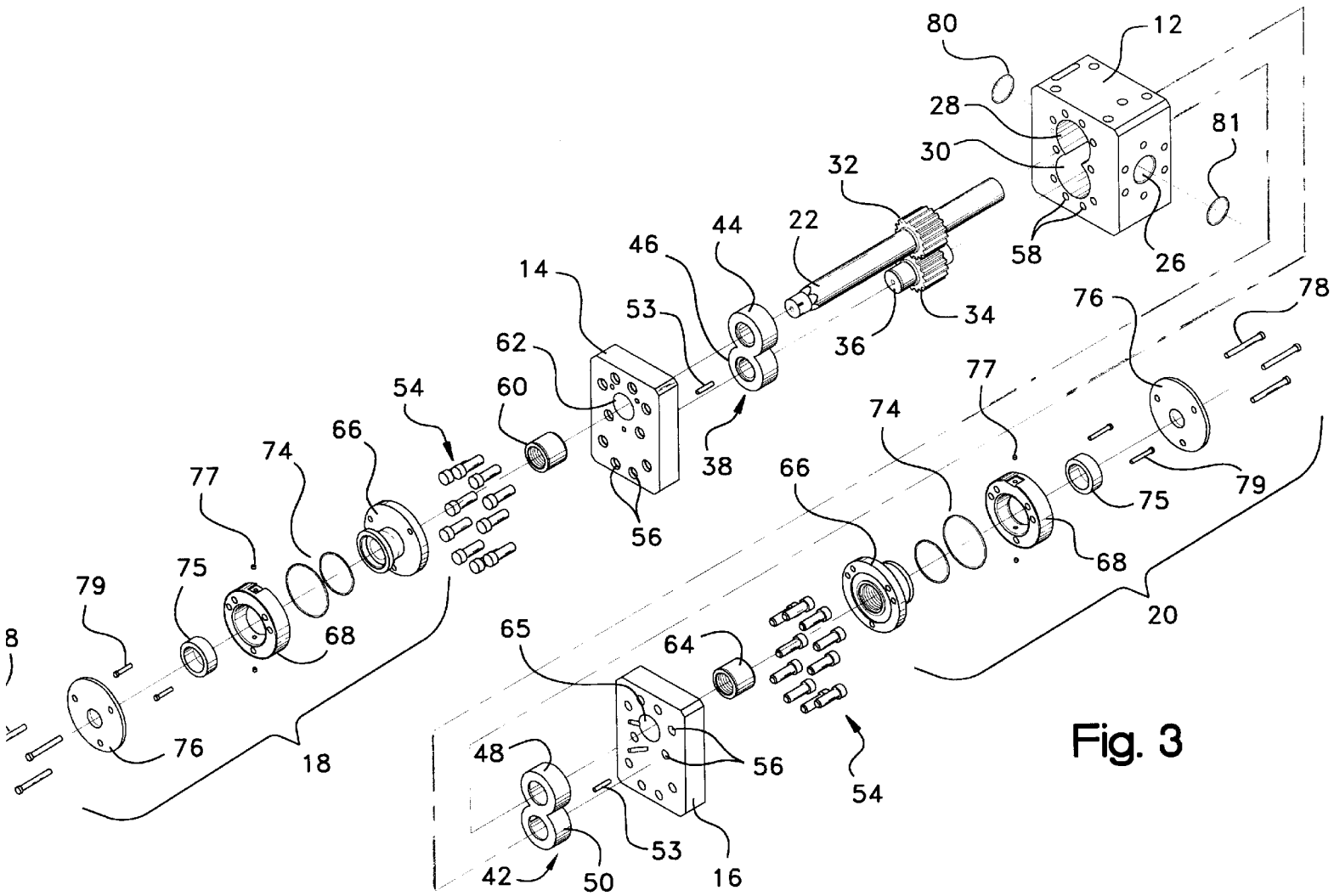
FIG. 3 is an exploded elevated perspective view of the gear pump of FIG. 1.

Referring now to FIGS. 2 and 3, pump body 12 includes a pair of generally cylindrical gear chambers 28, 30 configured to receive a pair of externally-toothed, circular gears 32, 34. Gear 32, the drive gear, is received within drive chamber 28; while gear 34, the driven gear, is received within driven chamber 30. Drive shaft 22 is received within drive gear 32 (and preferably formed in one piece therewith); while an arbor shaft 36 is received within gear 34 (and also preferably formed in one piece therewith). Gear chambers 28, 30 partially radially overlap one another, and the teeth on gears 32 and 34 intermesh along a median plane "P" bisecting pump body 12. The low pressure and high-pressure fluid ports 24, 26 each have a cylindrical configuration and are located generally along the media plane P, perpendicular to the axis of rotation of the gears.

The gears 32, 34 are supported for rotation upon a pair of bearing assemblies, indicated generally at 38, 42, which support opposite sides of the gears. Each bearing assembly includes a pair of bearings receiving one of the drive shaft or the arbor shaft. Specifically, a drive bearing 44 of bearing assembly 38 receives and radially supports one end of drive shaft 22, and is located in adjacent relation to one outer side of drive gear 32; while a driven bearing 46 of the bearing assembly 38 receives and radially supports one end of arbor shaft 36 and is located in adjacent relation to one outer side of driven gear 34. Similarly, a drive bearing 48 of the other bearing assembly 42 receives and radially supports the other end of drive shaft 22 and is disposed in adjacent relation to the opposite outer side of drive gear 32; while a driven bearing 50 of bearing assembly 42 receives and radially supports the other end of arbor shaft 36 and is disposed in adjacent relation to the opposite outer side of driven gear 34. A small key or pin 53 is provided to properly orient the bearings and prevent the bearings from rotating with respect to one another.

While the bearings are shown as being of a D-shaped configuration supported radially adjacent each other to form a bearing pair for each bearing assembly, the bearings could also be connected together or formed together as a single component, or could otherwise have different configurations. The bearings could also be fully supported within the cover plates 14, 16. The cover plates could likewise act as the bearings in particular applications.

In addition, while the bearings are shown in adjacent relation to the respective gear sides, it is also possible that, depending upon the application, a wear plate could be located between each of the gear sides and a respective bearing. In any case, such bearings and wear plates are well-known to those of ordinary skill in the art, are available from a variety of sources (including the assignee of the present invention), and will not be described further for sake of brevity.

Cover plates 14 and 16 retain bearing assemblies 38, 42 on opposite ends of drive shaft 22 and arbor shaft 36 and enclose the open ends of gear chambers 28, 30 in pump housing 12. Cover plates 14, 16 are fixedly attached to the opposite ends of pump housing 12 by a series of threaded fasteners, indicated generally at 54, which are received within corresponding through-bores, such as at 56, formed in plates 14, 16, and into threaded bores, such as at 58, formed in the opposite end surfaces of pump body 12.

A cylindrical sleeve 60 is closely received within a central opening 62 in cover plate 14, and a similar cylindrical sleeve 64 is closely received within a central opening 65 in cover plate 16. The inner ends of sleeves 60, 64 are received within annular grooves formed in the outer surface of the driving bearings 44, 48. The sleeves closely surround the drive shaft 22 to facilitate the rotation of the drive shaft 22 within the cover plates.

Each drive shaft sealing assembly 18, 20 includes an inner annular sealing plate 66 with an inner annular groove to receive the outer end of sleeves 60, 64, and a central opening to receive drive shaft 22. The inner sealing plates 66 are disposed in adjacent-facing relation to a respective cover plate 14, 16. Each sealing assembly further includes a ring seal 68, various O-ring seals 74, a wiper seal 75 and an outer annular sealing plate 76. The inner and outer sealing plates 66, 76, ring seal 68, O-rings 74 and wiper seal 75 receive and seal against the drive shaft 22, and prevent fluid leakage from each end of the pump housing. Ring seal 68 includes threaded plugs 77, which plug ports used to flush the seals with cooling fluid. The inner and outer sealing plates 66, 76, and ring seal 68 are fastened to a respective cover plate 14, 16, using threaded fasteners, as at 78, which are received within through-bores in plates 66, 76 and ring seal 68, and in corresponding threaded bores in plates 14, 16. Threaded fasteners 79 are also provided to fasten ring seal 68 directly to inner plate 66.

Conventional O-ring seals 80 81, are provided at the inlet and outlet ports 24, 26, respectively, for sealing purposes with the fittings to the fluid system (not shown).

The gear pump 10 described above is preferably formed from conventional materials, using conventional processes. These should be well known to those skilled in the art and will not be discussed further for sake of brevity.

During rotation of the drive shaft 22 in the clockwise direction (as seen from the right in FIG. 1), drive gear 32 and driven gear 34 are rotated to draw fluid from inlet port 24 at low pressure and provide the fluid at a higher pressure through outlet port 26. The fluid enters the low pressure fluid port 24, is drawn around the circumference of the gears by the rotating teeth, and is then directed through the high pressure fluid port 26. The intermeshing teeth prevent the fluid from escaping upstream between the gears along the median plane P. The bearing assemblies 38, 42 allow the gears 32, 34 to rotate freely with drive shaft 22 and around arbor shaft 36, while the sleeves 60, 64 and sealing assemblies 18, 20 prevent fluid from leaking around the drive shaft 22 exteriorly of the housing.

To lubricate the bearing assemblies 38, 42 during rotation of the drive gears, the present invention contemplates a novel recirculating flow path. Preferably, a flow path is provided from the high pressure fluid port 26, through the bearings, to the low pressure inlet port 24, with the location that the fluid is drawn from the high pressure side being different than the location that the fluid is reintroduced into the low pressure side, so that the fluid is prevented from recirculating again and again through the bearings. More preferably, fluid is drawn from the sides of the gears in the high pressure fluid port 26, is directed through the bearing assemblies from the inner side to the outer side of the bearings, through at least one flow channel between each cover plate and the respective bearing assembly, to one or more return bores in the gear pump body. The return bore(s) return the fluid centrally of the teeth on gears 32, 34 for re-introduction of the fluid into the fluid entering the low-pressure port. The drawing off of the lubricating fluid at a different location (axially) than where the fluid is re-introduced into the incoming flow path is important, as this results in the uniform mixing of the fluid into the incoming fluid stream to minimize recirculating the same fluid.

Figure 4:
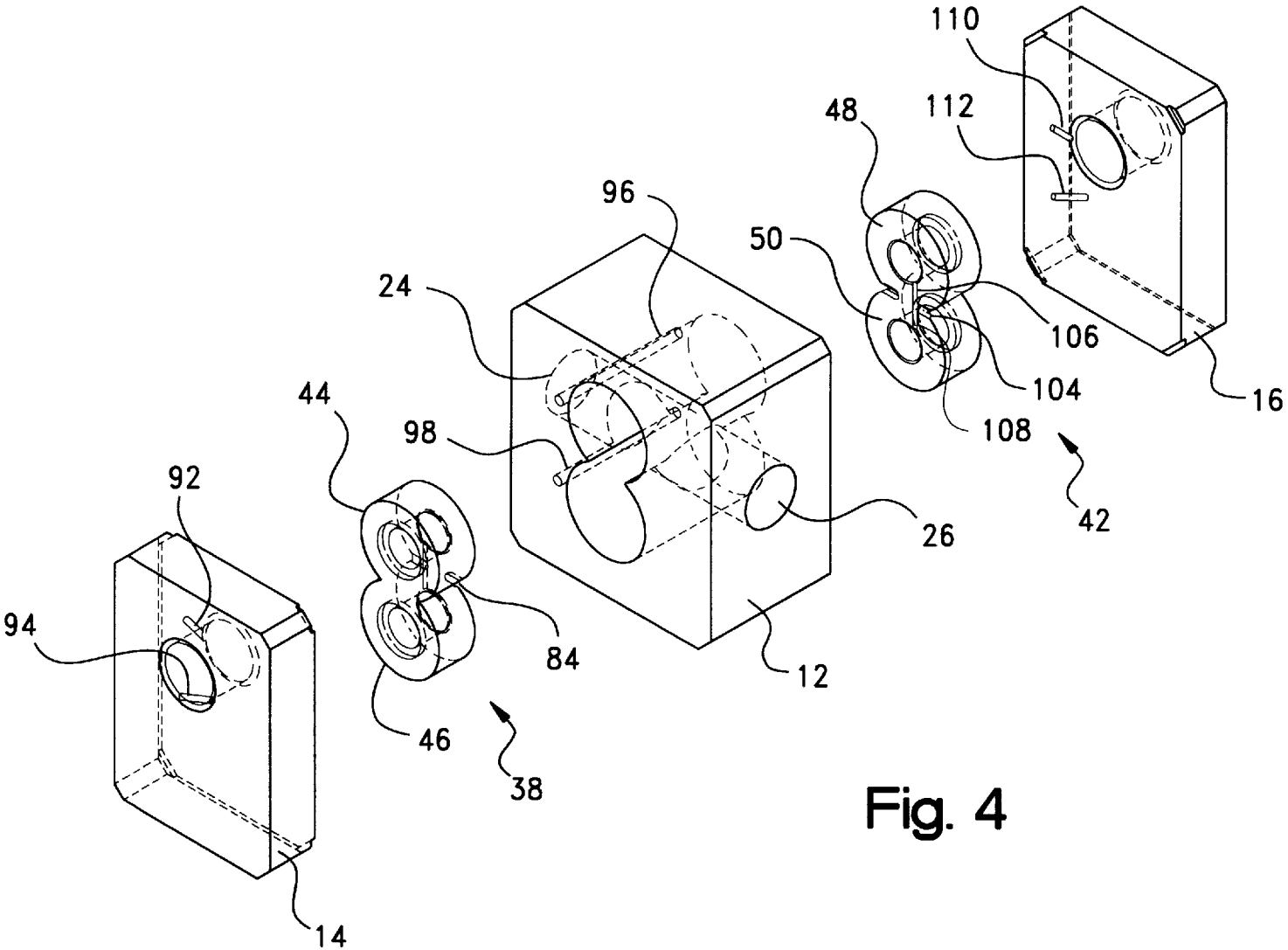
FIG. 4 is an exploded schematic illustration of certain components of the gear pump.
Figure 6:
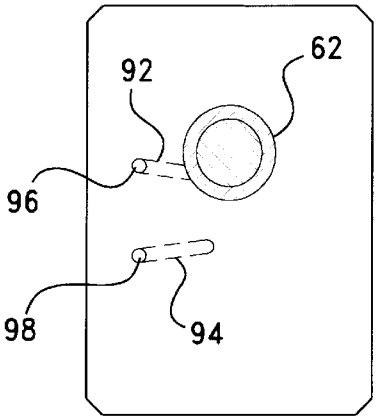
FIG. 6 is a cross-sectional end view of the gear pump taken substantially along the plane described by the lines 6—6 of FIG. 2.
Figure 5:
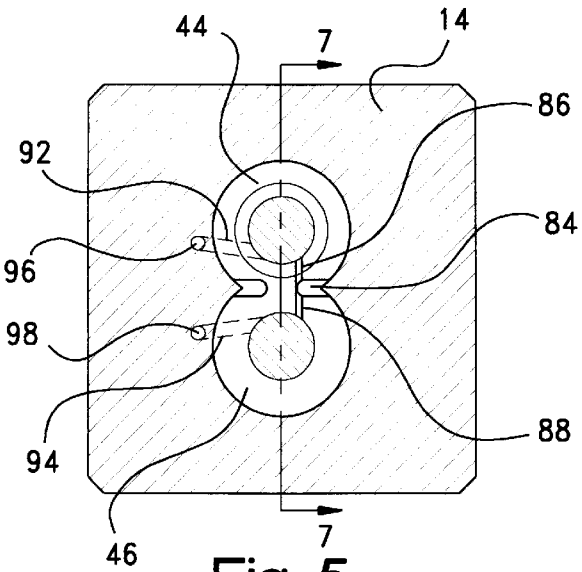
FIG. 5 is a cross-sectional end view of the gear pump taken substantially along the plane described by the lines 5—5 of FIG. 2.

Specifically, referring now to FIGS. 4–6, the flow path is preferably provided through each of the bearing assemblies 38, 42 in the same manner. Bearing assembly 38, for example, includes a channel or groove 84 formed along the inside surface of the bearing assembly facing the outer surface of the gears along the median plane P, that is, along the plane defined by the intermeshing teeth of the gears and opening centrally and axially into high pressure outlet port 26. A pair of short channels 86, 88, on the inside surface of the bearings then direct fluid from channel 84 into the central bore of each bearing 44, 46. Fluid then flows axially through each bearing from the inner side (the side facing the gears) to the outer side (the side facing the cover plate), to fully and properly lubricate each bearing. At the outer side of the bearings, the fluid flows from bearings 44, 46 into channels 92, 94, respectively, formed in the inner surface of cover plate 14. Channels 92, 94 direct the fluid between the outer surface of the bearings and the inner surface of the adjacent cover plate to the outer ends of a pair of return bores 96, 98 respectively, formed in pump body 12.

Figure 9:
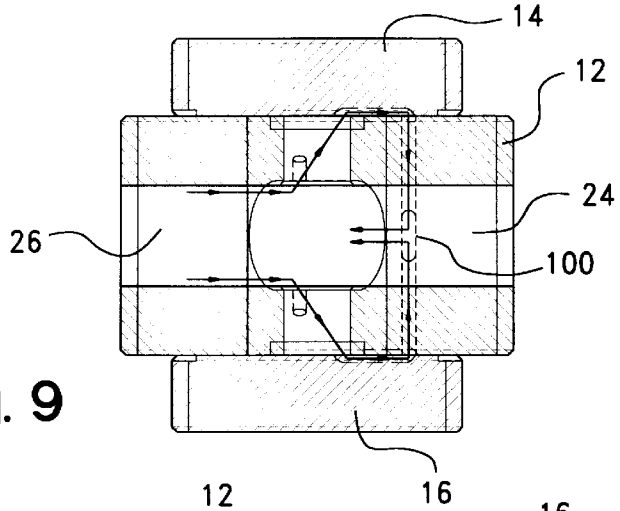
FIG. 9 is a cross-sectional bottom view of the gear pump taken substantially along the plane described by the lines 9—9 of FIG. 8.
Figure 8:
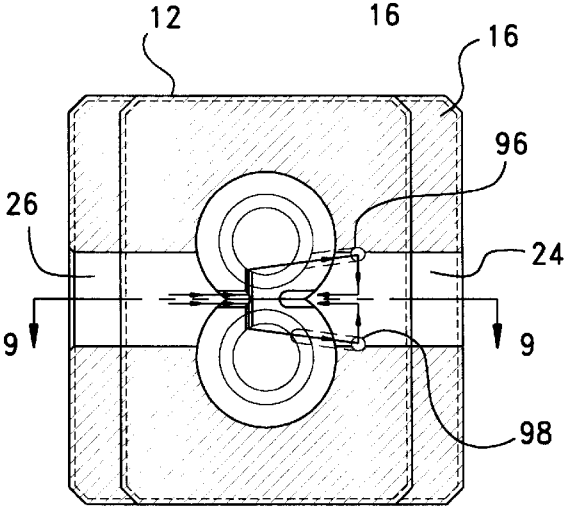
FIG. 8 is a cross-sectional end view of the gear pump taken substantially along the plane described by the lines 8—8 of FIG. 7.
Figure 7:
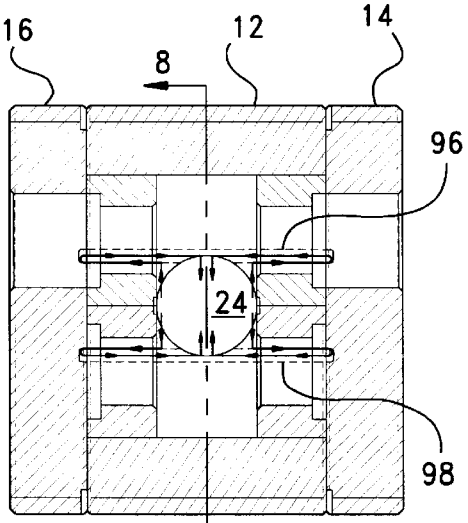
FIG. 7 is a cross-sectional side view taken substantially along the plane described by the lines 7—7 of FIG. 5.

Return bores 96, 98 extend through the housing parallel to one another and parallel to the rotational axis of the gears, on diametrically opposite sides of low pressure inlet port 24. As shown in FIGS. 7–9, each return bore 96, 98, preferably tangentially intersects the cylindrical inlet port, such that an elongated, arcuately-extending, elliptical flow opening is provided centrally into port 24 (see, e.g., opening 100 for return bore 98 in FIG. 9. The flow opening from return bore 96 has the same configuration). The elliptical flow openings are located somewhat upstream apart from the intermeshing gear teeth.

It is preferred that the return bores intersect the low pressure fluid port such that the bores are at least half open, and more preferably are fully open, at the point of maximum intersection with this port. The amount of intersection of the return bores 96, 98 with the low-pressure inlet port can vary (i.e., from essentially point contact with a small circular opening into the port to essentially two separate, non-radial flow openings directed toward one another from opposite sides of the port), depending upon the particular application. Also, while less preferred, a cross-bore could be drilled between one of the return bores and the low-pressure fluid port, opening into the port centrally of the gear teeth. In this case, the return bores may be spaced apart and not directly intersect the low-pressure fluid port. In any case, the flow opening should be at least great enough to direct all the fluid returning through the bores into the low pressure inlet port without a significant pressure drop; while at the same time, the opening should be maintained as close as possible to the central area of the gear teeth, such that the fluid flow is directed radially inward toward the central portion of the teeth (as best seen in FIG. 9).

While a pair of return bores 96, 98 are shown, the channels 92, 94 in cover plate 14 could alternatively intersect at their outer end (the end spaced from the bearings) and a single return bore could be provided to return the fluid back to the low pressure port 24. In this case, it is preferred that the return bore intersect the low pressure fluid port toward the bottom of the port, such that the warm recirculated fluid will flow upward also by convention to be mixed with the incoming fluid. Channels 92, 94 could also be formed partly (or wholly) in the outer surface of the bearing assemblies 38, 42; or if wear plates are used, the channels could be formed partly (or wholly) in the outer surface of the wear plates.

Thus, a portion of the fluid flow at the high pressure outlet port 26 is drawn along one side of the gears, directed between the gears and bearings in bearing assembly 38, axially through the bearings to lubricate the bearings, and then through the flow channels 92, 94 between the bearings and the cover plate 14. The fluid is then directed into the return bores 96, 98, where the fluid is then directed into the low pressure inlet port 24, centrally of the gear teeth, for uniform introduction into the low pressure inlet flow. This maximizes the uniform mixing of the flow with the inlet flow to prevent the same fluid from being recirculated through the bearings, as the fluid is drawn off at a different location (axially) on the high pressure side of the gear pump, then where the fluid is re-introduced on the low pressure side of the gear pump.

An identical flow path is preferably provided on the opposite side of the gears, through bearing assembly 42. This flow path includes a channel 104 formed on the inside surface of bearing assembly 42 facing the gears; short channels 106, 108 directing the fluid into the bearings 48, 50, respectively; and channels 110, 112 formed on the inside surface of cover plate 16 for directing the fluid from the bearings to the other end of return bores 96, 98. As described above, the return bores direct the fluid to the flow openings (as at 100) into the low-pressure return port 24.

The identical flow paths through the bearing assemblies 38, 42, and between cover plates 14 and 16 is balanced to facilitate the smooth operation of the gear pump. The pressure differential between the high-pressure fluid port and low-pressure fluid port causes the fluid to flow at an appropriate speed through the recirculating flow path. While less preferred, if a supplemental pressure source for the recirculating fluid is provided, such as spiral grooves through the bearings, it is possible that the recirculating flow path could be constructed so the fluid could be drawn from the low pressure fluid port 24 and reintroduced back into the fluid at the low pressure fluid port 24. This should be fairly apparent to those skilled in the art, without having to discuss this further.

In addition, while the preferred embodiment described above illustrates a recirculating flow path where the fluid is drawn from the medial plane, toward the sides of the gears, outward through the bearings and then returned to the central region of the gears, it is possible that (axial) location of drawing-off of the fluid and reintroduction of the fluid could be reversed with essentially the same results. That is, the ports could be switched, with low pressure fluid directed into port 26 and high pressure fluid directed out of port 24, and the rotation of the drive gear reversed, with the result that the recirculating flow path would have an inlet opening in the high pressure port which is centrally located across the gears—and the return port would be through the channel formed in the bearings along the sides of the gears. This would also cause the recirculating fluid to mix uniformly with the incoming fluid and prevent the same fluid from recirculating again and again.

It should also be appreciated that the recirculating flow path is relatively straightforward to form in the pump body, that is, channels can be easily formed (e.g. cut or cast) in the inner surface of the bearings of the bearing assembly; a pair of channels can also be easily formed (e.g., cut or cast) into the inner surface of the cover plates; and a pair of cylindrical bores can be easily formed (e.g., drilled) through the housing 12, opening into the low pressure inlet port 24. The easy manufacture of the gear pump with a recirculating flow path minimizes (or at least reduces) the costs associated with such a gear pump.

Thus, as described above, the present invention provides a novel and unique gear pump which provides a recirculating flow path which lubricates the bearings of the gear pump, and which re-introduces recirculated fluid for uniform introduction of the fluid back into the incoming fluid stream. Such a gear pump is easy to manufacture, which reduces the cost of the pump.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A gear pump assembly, comprising:

a pump body having a pair of cylindrical gear chambers partially radially overlapping one another and opening into opposite open ends of said body, said pump body further having low-pressure and high-pressure cylindrical fluid ports into said cylindrical gear chambers, a pair of cover plates, each cover plate enclosing a respective open end of the body, a pair of externally-toothed gears rotatably disposed about parallel axes on bearing assemblies, each gear disposed in a respective gear chamber and having intermeshing teeth during rotation, said high-pressure and low-pressure fluid ports oriented relative to the gears to direct fluid into the intermeshing gear teeth such that low pressure fluid enters the pump body through the low-pressure fluid port and high pressure fluid leaves the pump body through the high-pressure fluid port, a drive shaft connected along the axis of one of said gears for rotation of said gears, a flow path defined between a high pressure side and low pressure side of the gear pump, including a first return port opening into one of the fluid ports toward one side of the gears, through one bearing assembly to lubricate the bearing assembly, and through a flow channel to a bore, with the bore having a second return port opening into the other of the fluid ports centrally of the gear teeth.

2. The gear pump assembly as in claim 1, wherein said bore is formed parallel to the rotational axis of the gears and tangentially intersects the other fluid port apart from the intermeshing gear teeth, the flow path recirculating fluid from the high pressure side of the pump to the low pressure side of the pump.

3. The gear pump assembly as in claim 1, wherein said second return port opening is an elongated, arcuately-extending elliptical opening into the other fluid port.

4. The gear pump assembly as in claim 1, wherein a flow channel is provided in each cover plate, with each flow channel directing fluid from a respective bearing assembly to a respective end of the bore.

5. The gear pump assembly as in claim 1, wherein the bearing assemblies each have a channel formed on the inner surface of the bearing assemblies facing the respective outer side of the gears, said channel opening centrally and axially into the one fluid port.

6. The gear assembly as in claim 1, wherein the flow path also includes a second return port opening into the one of the fluid ports toward another side of the gears, and through the other bearing assembly to the bore, the fluid from the opposite sides of the gears being provided to opposite ends of the bore.

7. The gear pump assembly as in claim 1, wherein the flow path recirculates fluid from the high pressure side to the low pressure side of the gear pump.

8. The gear pump assembly as in claim 7, wherein said bore opens directly into the one fluid port.

9. A gear pump assembly, comprising:

a pump body having a pair of cylindrical gear chambers partially radially overlapping one another and opening into opposite open ends of said body, said pump body further having low pressure and high pressure cylindrical fluid ports into said cylindrical gear chambers, a pair of cover plates, each cover plate enclosing a respective open end of the body, a pair of externally-toothed gears rotatably disposed about parallel axes, each gear disposed in a respective gear chamber and having intermeshing teeth during rotation, said high pressure and low pressure fluid ports oriented relative to the gears to direct fluid into the intermeshing gear teeth such that low pressure fluid enters the pump body through the low pressure fluid port and high pressure fluid leaves the pump body through the high pressure fluid port, a drive shaft connected along the axis of one of said gears and extending through an opening in at least one of said cover plates for rotation of said gears, and an arbor shaft supporting the other of said gears, a bearing assembly located between each side of the gears and a respective cover plate, each bearing assembly including a pair of bearings, with each bearing disposed in adjacent relation to a respective side of a respective gear, a flow path provided from the high pressure fluid port, through an inner side to an outer side of the bearings of the respective bearing assemblies, and between an outer side of the bearings and the respective cover plate into opposite ends of at least one return bore, with said at least one return bore directing fluid from the bearing assembly to a return outlet port opening into the low pressure fluid port centrally of the gear teeth, said at least one return bore formed parallel to the rotational axis of the gears and tangentially intersecting the low pressure fluid port upstream from the intermeshing gear teeth to recirculate fluid drawn from the high-pressure side of the pump to a location centrally of the gear teeth on the low-pressure side of the pump.

10. The gear pump assembly as in claim 9, wherein said return outlet port opening is an elongated, arcuately-extending elliptical opening into the low pressure fluid port.

11. The gear pump assembly as in claim 9, wherein the bearing assemblies each have a channel formed on the inner side of the bearing assemblies facing the respective outer side of the gears, said channel opening centrally and axially into the high pressure fluid port.

12. The gear pump assembly as in claim 9, wherein said at least one return bore is cylindrical.

13. The gear pump assembly as in claim 12, wherein said at least one return bore opens fully into the low-pressure fluid port at the point of maximum intersection with the low-pressure fluid port.

14. A gear pump assembly, comprising:

a pump body having a pair of cylindrical gear chambers partially radially overlapping one another and opening into opposite open ends of said body, said pump body further having low-pressure and high-pressure cylindrical fluid ports into said cylindrical gear chambers, a pair of cover plates, each cover plate enclosing a respective open end of the body, a pair of externally-toothed gears rotatably disposed about parallel axes, each gear disposed in a respective gear chamber and having intermeshing teeth during rotation, said high-pressure and low-pressure fluid ports oriented relative to the gears to direct fluid into the intermeshing gear teeth such that low pressure fluid enters the pump body through the low-pressure fluid port and high pressure fluid leaves the pump body through the high-pressure fluid port, a drive shaft connected along the axis of one of said gears and extending through an opening in at least one of said cover plates for rotation of said gears, and an arbor shaft supporting the other of said gears, a bearing assembly located between each side of the gears and a respective cover plate, each bearing assembly including a pair of bearings, with each bearing disposed in adjacent relation to a respective side of a respective gear, a flow path provided from a return inlet port opening into the high-pressure fluid port, between an inner side of each bearing assembly and an outer side of the gears, through each bearing for lubrication of the bearings, to an outer side of the bearings facing the respective cover plate, and between the outer side of each bearing assembly and an inner side of the respective cover plate to opposite ends of a pair of return bores, each of said return bores formed parallel to the rotational axis of the gears and extending through the pump body to a return outlet port opening into the low-pressure fluid port centrally of the gear teeth, the return bores located on diametrically opposite sides of the low-pressure port and tangentially intersecting the low-pressure port upstream from the intermeshing gear teeth to recirculate fluid drawn from the high-pressure side of the pump along the sides of the gears to a location centrally of the gear teeth on the low-pressure side of the pump.

15. The gear pump assembly as in claim 14, wherein each return outlet port opening is an elongated, arcuately-extending elliptical opening into the low pressure fluid port.

16. The gear pump assembly as in claim 14, wherein a pair of flow channels are provided in each cover plate, with each flow channel directing fluid from a respective bearing to a respective end of a respective return bore.

17. The gear pump assembly as in claim 14, wherein the bearing assemblies each have a channel formed on the inner side of the bearing assemblies facing a respective outer side of the gears, said channel opening centrally and axially into the high pressure fluid port.

18. The gear pump assembly as in claim 14, wherein said return bores are cylindrical.

19. The gear pump assembly as in claim 18, wherein said return bores open fully into the low-pressure fluid port at the point of maximum intersection with the low-pressure fluid port.

20. The gear pump assembly as in claim 19, wherein a flow channel is provided in each cover plate, with each flow channel directing fluid from a respective bearing assembly to a respective end of the at least one return bore.

* * * * *